United States Patent [19]

Palm et al.

[11] Patent Number: 5,008,979

[45] Date of Patent: Apr. 23, 1991

[54] TEXTILE-FIBER TREATING GROOVED ROLLER AND A WIRE WITH TEETH HAVING A FOOT PORTION INDENTED FOR FORCE-FITTING THE WIRE INTO THE GROOVE AND METHOD OF MAKING SAME

[75] Inventors: Gangolf Palm, Wegberg; Karl-Heinz Lehmann; Hans-Joachim Heinemann, both of Mettmann, all of Fed. Rep. of Germany

[73] Assignee: Peter Wolters AG, Rendsburg, Fed. Rep. of Germany

[21] Appl. No.: 337,384

[22] Filed: Apr. 13, 1989

[30] Foreign Application Priority Data

Apr. 13, 1988 [DE] Fed. Rep. of Germany ..... 3812247

[51] Int. Cl.[5] ..... D01G 15/18; D01G 15/46; B21B 27/02

[52] U.S. Cl. ..... 19/97; 19/55 R; 19/105; 19/114; 29/895.211

[58] Field of Search ..... 19/55, 97, 105, 114; 29/148.4 D

[56] References Cited

U.S. PATENT DOCUMENTS

| | | | |
|---|---|---|---|
| 1,688,418 | 10/1928 | Hancock | 19/97 |
| 1,700,621 | 1/1929 | Allen . | |
| 2,175,131 | 10/1939 | Schwartz | 19/97 |
| 3,098,285 | 7/1963 | Kelzenberg | 29/148.4 D |
| 3,740,809 | 6/1973 | Wolstencroft | 29/148.4 D |
| 4,044,427 | 8/1977 | Ankrom | 19/97 |
| 4,149,303 | 4/1979 | Appenzeller | 19/97 X |
| 4,270,254 | 6/1981 | Berglöff | 29/148.4 D |
| 4,272,865 | 6/1981 | Schmolke | 19/97 |
| 4,291,437 | 9/1981 | Yoshizawa | 19/97 X |

FOREIGN PATENT DOCUMENTS

| | | |
|---|---|---|
| 0013169 | 9/1980 | European Pat. Off. . |
| 2539089 | 3/1977 | Fed. Rep. of Germany . |
| 854090 | 11/1960 | United Kingdom . |

*Primary Examiner*—Werner H. Schroeder
*Assistant Examiner*—Ismael Izaguirre
*Attorney, Agent, or Firm*—Herbert Dubno; Andrew Wilford

[57] ABSTRACT

A roller for the treatment of fiber masses for the textile industry has a sawtooth wire received in a rectangular cross section helical groove of a steel roll body and indented by a peening or indenting roller to provide, by plastic deformation of the foot portion, the outward forces which clamp the foot portion of the wire against the ribs flanking the groove of the roller body. As a consequence, the roller body as a whole is not deformed.

8 Claims, 1 Drawing Sheet

TEXTILE-FIBER TREATING GROOVED ROLLER AND A WIRE WITH TEETH HAVING A FOOT PORTION INDENTED FOR FORCE-FITTING THE WIRE INTO THE GROOVE AND METHOD OF MAKING SAME

Our present invention relates to a roll or roller for the treatment of fibrous material and, more particularly, to a roller of this type which is formed with sawtooth projections and is used in the textile industry for the processing of fiber masses by running the fiber masses between pairs of such rollers. The invention also relates to a method of fabricating such a roller.

BACKGROUND OF THE INVENTION

It is known to provide, for the treatment of fibrous material in the textile industry, a roller which is formed with one or more grooves in a screwthread or helical pattern and a sawtooth wire which is received in the grooves.

The wire can have a lower or foot portion which is of generally rectangular cross section and can fill the groove, the teeth, which are of sawtooth configuration, being integral with the foot or base portion and projecting beyond the periphery of the roller.

In such rollers, the sawtooth wire can be rolled into the thread-like groove so that the ribs separating the turns of the groove or separating the grooves from one another are plastically deformed as the wire is forced into the grooves so as to provide a force-fit in which the clamping force resulting from deformation of the ribs of the roller body seizes the sawtooth wire and holds it in place.

As a consequence, earlier techniques in the fabrication of such rollers have required a certain deformation of the material of the roller body. While such deformation is easily possible with a roll body composed of aluminum, when steel is used as the roller body the deformation of the intergroove ribs requires a significantly higher force than that required for the deformation of aluminum.

As a consequence, by and large, steel has been avoided as a material for the roller body. However, the use of aluminum for the roller body is disadvantageous because, during the setting of the sawtooth wire in the groove and the deformation of the ribs, there is insufficient stability of the aluminum body and an overall deformation of the latter can occur.

OBJECTS OF THE INVENTION

It is, therefore, the principal object of the present invention to provide an improved roller for the treatment of fiber masses in the textile industry whereby these disadvantages are avoided.

Another object of the invention is to provide an improved method of fabricating a roller for the purposes described which can avoid the overall deformation problems which have hitherto been encountered.

It is also an object of our invention to provide an improved fastening technique for securing a sawtooth wire in a roller body by a rolling action, such that it is possible to use relatively strong, hard and high-strength materials, such as steel, for the roller body.

SUMMARY OF THE INVENTION

These objects and others which will become more apparent hereinafter are attained, in accordance with the present invention, by a rolling of the foot or base portion of the sawtooth wire into the rectangular cross section groove of a roller body, preferably of steel as previously described, so that a peening or indentation of the foot portion is provided, thereby eliminating the need to deform the rib adjoining the groove and allowing the foot portion of the wire nevertheless to engage the flanks and bottom of the groove with an excellent gripping force. The peening or indentation operation, preferably effected during the rolling, results in an actual plastic deformation of the foot portion of the wire which remains and which provides the flow of the foot portion material necessary to ensure effective clamping engagement of the foot portion between the ribs bounding the or each groove.

According to the invention, therefore, the deformation of the foot of the sawtooth wire eliminates the need for deforming or distorting the roller body altogether so that the fastening technique can be independent of the roller body material. As a consequence, the roll body can especially be made of steel.

It is especially advantageous when the indentation or peening of the foot portion causes the plastically deformed material of the foot portion to slightly overhang an edge of an adjoining rib.

According to another feature of the invention, the adjoining rib can be simultaneously indented or peened by the indentation roller so that the indentations of the rib and of the foot portion merge together. In this case, the ribs of the roll are indented together with the foot portions and thus the plastic deformation does not affect only the foot portion. Relatively slight deformation of both materials, therefore, will generally suffice. As a consequence, no overall deformation of the roller body can occur. More specifically, the roller for the treatment of a fibrous mass in the textile industry of the present invention will comprise:

a roller body having a generally cylindrical periphery formed with at least one generally helical outwardly open groove of generally rectangular configuration; and a wire having a foot portion received in and filling said groove and of generally rectangular cross section, and a succession of teeth in a sawtooth configuration projecting outward from said foot portion and formed unitarily therewith over substantially the entire length of said wire, said foot portion being indented so as to force fit in said groove.

The method of the invention can thus comprise the steps of:

(a) providing a roller body having a generally cylindrical periphery formed with at least one generally helical outwardly open groove of generally rectangular configuration;

(b) fitting a wire having a foot portion of generally rectangular cross section into said groove so that said foot portion substantially fills said groove, said wire being formed with a succession of teeth in a sawtooth configuration projecting outward from said foot portion and formed unitarily therewith over substantially the entire length of said wire; and (c) thereafter indenting said foot portion so as to force fit said foot portion in said groove.

BRIEF DESCRIPTION OF THE DRAWING

The above objects, features and advantages of our invention will become more readily apparent from the following description, reference being made to the accompanying drawing in which.

SPECIFIC DESCRIPTION

Figure 2:
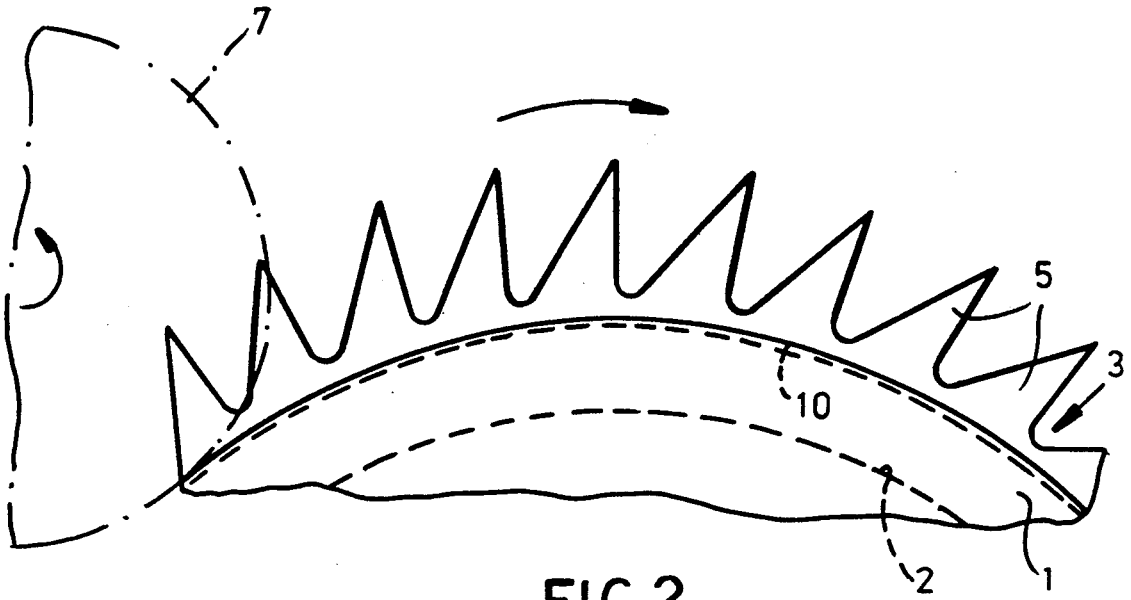
FIG. 2 is a section taken along the line II—II of FIG. 1.
Figure 1:
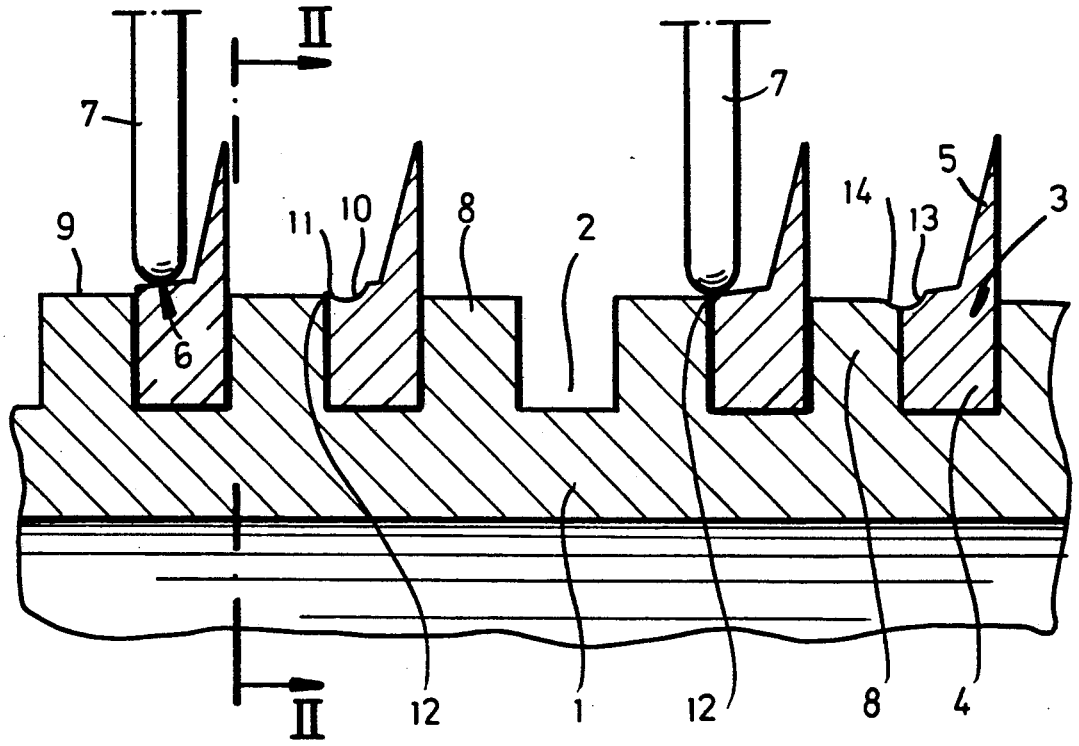
FIG. 1 is an axial section through a portion of a roller body according to the invention.

FIGS. 1 and 2 show a hollow roller body 1 composed of steel and formed with at least one helical groove or flute 2 of rectangular cross section, the turns of the groove being equispaced from one another within the grooves 2. A sawtooth wire 3 having a foot or base region 4 which likewise is of rectangular cross section fits snugly in the groove 2 and fills it. As will be apparent from FIG. 1, the upper portion of the foot region 4 normally lies above the surface 9 of the roller body.

The grooves 2 are bounded by ribs 8.

The sawtooth-shaped teeth 5 of the wire 3 are formed unitarily on the foot portion 4 offset to one side, i.e. to the right thereof as is clearly visible from FIG. 1. As a consequence, adjoining the teeth 5 an upper surface 6 of the foot region remains free for engagement by a peening roller 7 capable of indenting or deforming the foot region so as to provide an indentation 10 therein such that the resulting plastic deformation causes a portion 11 of the foot region to overhang the edge 12 of the respective rib 9.

Alternatively, as can be seen on the right in FIG. 1, the peening or indenting roller 7 may be so pressed against the wire 3 and the roller body 1 that an indentation 13 is formed in the edge of the foot portion 4 and a slight indentation 14 is provided in the edge region 12 of the rib 8. In either case, the plastic deformation or peening of the foot portion 4 locks the wire in place.

We claim:

1. A roller for the treatment of a textile-fiber mass, the roller comprising:

a steel roller body having a generally cylindrical periphery formed with at least one generally helical outwardly open groove of generally rectangular configuration and having a pair of opposing flanks and a bottom; and a wire having a foot portion received in and filling said groove and of generally rectangular cross section, and a succession of teeth in a sawtooth configuration projecting outward from said foot portion and formed unitarily therewith over substantially the entire length of said wire, said foot portion being indented so as to be deformed to force fit the foot portion in said groove against said flanks.

2. The roller defined in claim 1 wherein the groove has an edge and said foot portion is indented to overlie the edge of the groove.

3. A roller for the treatment of a textile-fiber mass, said roller comprising:

a roller body having a generally periphery formed with at least one generally helical outwardly open groove of generally rectangular configuration, said body being formed with an edge defining said groove; and a wire having a foot portion received in and substantially filling said groove and of generally rectangular cross section, said wire being provided with a succession of teeth in a sawtooth configuration projecting outward from said foot portion, said teeth being formed unitarily with said foot portion over substantially the entire length of said wire, said foot portion being indented along at least a part thereof so as to force fit said wire in said groove.

4. A method of forming a roller for the treatment of a textile-fiber mass, the method comprising the steps of:

(a) providing a roller body having a generally cylindrical periphery formed with at least one generally helical outwardly open groove of generally rectangular configuration and having a pair of opposite flanks and edges, said body being provided with an edge defining said groove;

(b) fitting a wire having a foot portion of generally rectangular cross section into said groove so that said foot portion substantially fills said groove and adjoins at least one of the edges, said wire being formed with a succession of teeth in a sawtooth configuration projecting outwardly from said foot portion and formed unitarily therewith over substantially the entire length of said wire; and (c) thereafter indenting said foot portion adjacent said edge so as to force fit said foot portion in said groove into tight engagement with the flanks thereof.

5. The method defined in claim 4 wherein said foot portion is indented to overlie one of the edges of the groove.

6. The method defined in claim 4 wherein said indentation is formed by pressing a peening roller into said foot portion adjacent said teeth.

7. The method defined in claim 4 wherein said body is composed of a hard material.

8. The method defined in claim 4 wherein said body is composed of steel.

* * * * *